US005130601A

United States Patent [19]

Walker et al.

[11] Patent Number: 5,130,601

[45] Date of Patent: Jul. 14, 1992

[54] QUICK WARM-UP CATHODE HEATER FOR HIGH AVERAGE POWER MAGNETRONS

[75] Inventors: Christopher M. Walker, Montoursville, Pa.; Geoffrey Thornber, Aptos, Calif.; Robert C. English, Montoursville, Pa.

[73] Assignee: Litton Systems, Inc., Beverly Hills, Calif.

[21] Appl. No.: 493,497

[22] Filed: Mar. 14, 1990

[51] Int. Cl.[5] ..... H01J 01/20; H01J 25/50

[52] U.S. Cl. ..... 313/15; 313/270; 313/337; 313/341; 315/39.51

[58] Field of Search ..... 313/15, 270, 337, 341, 313/344; 315/39.51, 39.57

[56] References Cited

U.S. PATENT DOCUMENTS

| | | | |
|---|---|---|---|
| 652,635 | 6/1950 | Potter | 313/15 X |
| 3,403,281 | 9/1968 | Weaver | 313/337 |
| 3,465,201 | 9/1969 | Dorgelo | 315/39.51 |
| 3,881,126 | 4/1975 | Boots et al. | 313/337 |
| 4,494,034 | 1/1985 | Keller | 313/337 X |
| 4,683,401 | 7/1987 | Okazaki | 315/39.51 X |

*Primary Examiner*—Donald J. Yusko
*Assistant Examiner*—Ashok Patel
*Attorney, Agent, or Firm*—Poms, Smith, Lande & Rose

[57] ABSTRACT

An uncoated radiative heating filament wire is electrically and thermally isolated from the cathode of a high power magnetron. The filament wire helically surrounds the cathode support rod and is suspended above the support rod surface by ceramic members. A reflective shell envelops the helical filament wire and cathode support rod. The shell reflects radiated heat from the filament wire evenly upon the cathode support rod.

10 Claims, 1 Drawing Sheet

QUICK WARM-UP CATHODE HEATER FOR HIGH AVERAGE POWER MAGNETRONS

FIELD OF THE INVENTION

The present invention relates generally to microwave frequency electrical components and, more particularly, to a magnetron cathode warm-up apparatus.

BACKGROUND OF THE INVENTION

In high average power magnetrons, the cathode is generally subjected to high levels of incident energy. When this energy is present during normal operations, it creates a large temperature gradient across the cathode structure which causes damage if not dissipated. In the prior art, cathode heaters have been developed to conduct heat to the cathode. The cathode may then be at operating temperature upon start up of the magnetron.

A commonly used prior art cathode heater is of the "soldering iron" type. A soldering iron cathode heater uses a coated filament wire which is wound on a solid rod connected to the emitter. The wire is heated by resistive losses when a voltage is coupled to the wire. The heat is then conducted through the rod to the emitter. However, soldering iron cathode heaters present numerous disadvantages and limitations. Such heaters cannot be heated rapidly. The normal warm-up time for such heaters can be as much as five minutes. If the temperature of the wire is too hot, its coating will burn, thereby causing the magnetron to fail. A further disadvantage and limitation with soldering iron cathode heaters is the large thermal mass required, which is unacceptable for many applications where weight savings is a critical factor. Thus, it would be highly desirable to provide a high speed, low weight cathode warm-up heater for high average power magnetrons.

SUMMARY OF THE INVENTION

According to the present invention, the above described disadvantages and limitations of the prior art are eliminated by use of an uncoated radiative heating filament wire which is electrically and thermally isolated from the cathode. The heating filament wire helically surrounds the cathode support rod and is suspended above the support rod surface by a plurality of ceramic members. A reflective shell envelops the helical filament and cathode support rod, which further reflects radiated heat evenly upon the cathode support rod.

Therefore, the present invention has numerous advantages over the prior art. A first advantage is that a lightweight cathode support structure can be used. A second advantage is that coated wire is unnecessary since the wire is isolated from the cathode support structure. A further advantage is the quick warm-up of the cathode structure since uncoated wire can reach higher temperature than coated wire, and the reduced cathode structure mass can conduct heat to the emitter faster.

These and other objects, advantages and features of the present invention will become readily apparent to those skilled in the art from the following description of the exemplary preferred embodiment of the present invention when read in conjunction with the attached drawings and appended claims.

DESCRIPTION OF THE PREFERRED EXEMPLARY EMBODIMENT

Figure 1:
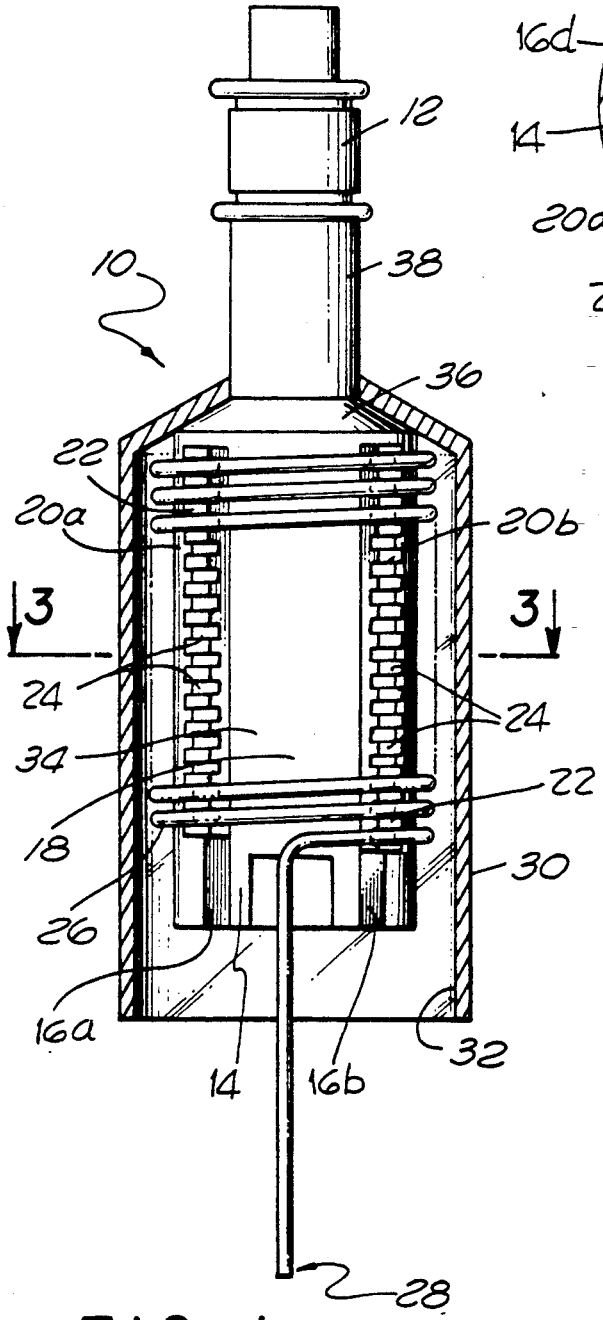
FIG. 1 is a side view of an exemplary cathode warm-up apparatus.

Referring to FIG. 1, there is shown an exemplary cathode warm-up apparatus 10. The apparatus 10 is substantially comprised of a cathode support rod 18 which is constructed of an electrically and thermally conductive metal, such as molybdenum. A cathode body 14 is formed at a first end of the cathode support rod 18 and a cathode emitter surface 12 is formed at a second end thereof. The cathode support rod 18 has a first cylindrical portion 34 of a first radius at the cathode body end. A second cylindrical portion 38 is of a lesser or narrower, second radius at the emitter end. Intermediate to the first cylindrical portion 34 and second cylindrical portion 38 is a tapered portion 36.

Figure 3:
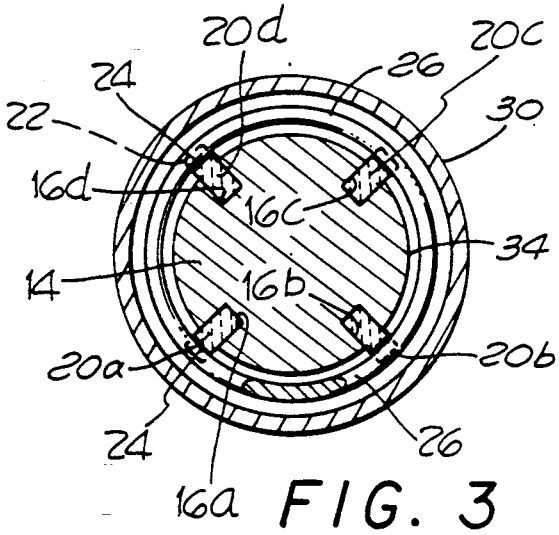
FIG. 3 is a section view of an exemplary cathode warm-up apparatus through the plane 3—3 of FIG. 1.

On the first cylindrical portion 34 of support rod 18, a plurality of axially elongated mounting slots **16*a*–16*d* are formed. The slots 16*a*–16*d* are equally spaced radially about the circumference of the first cylindrical portion 34 with slots 16*a* and 16*b* shown in FIG. 1, while slots 16*a*–16*d* are shown in FIG. 3. In the preferred exemplary embodiment of the present invention, there are four slots 16, although any sufficient number of slots may be utilized, as will become apparent from the following description. A plurality of elongated insulating members 20*a*–20*d* are constructed of a size dimensioned to be received by the slots 16, and are securely inserted into the slots 16. Only members 20*a* and 20*b* are shown in FIG. 1, while members 20*a*–20*d* are shown in FIG. 3. The height of the insulating members 20 is greater than that of the depth of the slots 16, such that a protruding surface 22 extends outwardly relative the first cylindrical portion 34**.

Figure 2:
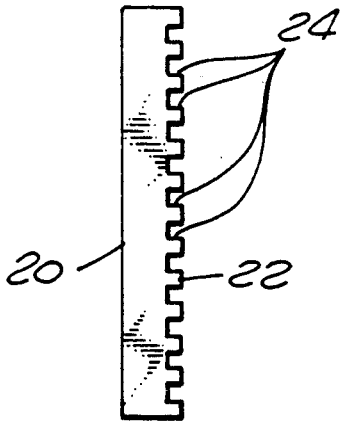
FIG. 2 is a view of an exemplary thermally insulated support member.

The insulating members 20 have a multiplicity of notches 24 in the protruding surface 22, as shown in FIG. 2. A coiled filament wire 26 is wound helically about the first cylindrical portion 34 of the support rod 18 and is received by the notches 24. The insulating members 20 preclude the filament wire 26 from contacting any part of the first cylindrical portion 34 as best seen in FIG. 3. The two ends of the filament wire 26 terminate at terminals 28, only one of which is shown, and are adapted to be connected across a voltage source, not shown.

A shell 30 surrounds the first cylindrical portion 34 of the support rod 18. The internal surface 32 of the shell 30 is thermally reflective, with a space between the internal surface 32 and the coiled filament wire 26. The shell 30 includes a tapered, partially closed end 31 which rigidly mounts to the support rod 18 at the tapered portion 36 of support rod 18.

Upon application of a voltage to terminals 28 across the filament wire 26, the wire rapidly increases in temperature. Heat from the wire 26 is radiated onto the cylindrical portion 34 of the support rod 18, which then conducts the heat through portions 36 and 38 of support rod 18 to the cathode emitter surface 12. The shell 30 contains the radiated heat and further reflects the heat onto the first cylindrical portion 34 of support rod 18 to increase its radiant heating. The insulating members 20, remain at a lower temperature than the wire. Therefore, the cathode emitter surface 12 can rapidly reach operating temperature via surface conduction without the heat from the wire 26 damaging the core of the cathode support rod 18.

There has been described hereinabove a novel warm-up apparatus for a cathode in a high average power magnetron. It is apparent that those skilled in the art may now make numerous uses of and departures from the above described embodiment without departing from the inventive concept disclosed herein. Accordingly, the present invention is to be defined by the scope of the following claims.

We claim:

1. In a high average power magnetron having a cathode emitter surface and a cathode body, a cathode warm-up apparatus comprising:

a cathode support rod structurally interconnecting said cathode emitter surface and said cathode body, said cathode body having a plurality of elongated mounting slots therein and said cathode emitter surface being free of such slots;

a plurality of elongated members constructed from a thermally insulative material, each of said members being dimensioned to be received by a respective one of said slots and having an edge extending outwardly from said respective one of said slots, said edge having a plurality of notches therein; and a coiled filament wire wound about said cathode body and received by said notches and being adapted from electrical connection across a voltage source; wherein application of voltage from said voltage source to said filament wire causes a rapid increase in temperature of said wire, which radiates heat to said cathode body and said support rod to conduct heat to said cathode emitter surface, rapidly bringing said emitter surface to an operating temperature.

2. The cathode warm-up apparatus of claim 1 further comprising:

a shell surrounding said cathode support rod and having a thermally reflective interior surface, said shell providing a space between said wire and said interior surface wherein radiated heat from said wire is uniformly reflected onto the surface of said cathode body and said support rod.

3. The cathode warm-up apparatus of claim 2 wherein said cathode support rod has a first cylindrical portion relative said cathode body, a second cylindrical portion relative said cathode emitter surface, and a tapered portion intermediate said first and second portions, said first cylindrical portion being of a first radius and said second cylindrical portion being of a second lesser radius, and said shell being affixed to said cathode support rod at said tapered portion.

4. The cathode warm-up apparatus of claim 1 wherein said slots are axially disposed in substantially equal radial sectors.

5. The cathode warm-up apparatus of claim 4 wherein said slots number four.

6. The cathode warm-up apparatus of claim 3 wherein said slots extend the full length of said first cylindrical portion.

7. The cathode warm-up apparatus of claim 1 wherein said material of said thermally insulative members is further electrically insulative.

8. The cathode warm-up apparatus of claim 7 wherein said wire is uncoated and helically wound about said cathode body.

9. The cathode warm-up apparatus of claim 1 wherein said material of said thermally insulative members is ceramic.

10. In a high average power magnetron having a cathode emitter surface and a cathode body, a cathode warm-up apparatus comprising:

a cathode support rod interconnecting said cathode emitter surface and said cathode body;

an uncoated filament wire helically coiled about said cathode body;

said cathode emitter surface being free of said helically coiled filament wire; and said filament wire being thermally and electrically isolated from said cathode body and being adapted for electrical connection across a voltage source; wherein application of a voltage across said wire causes a rapid increase in temperature of said wire which radiates heat to said support rod to conduct heat to said emitter.

* * * * *